US006969791B2

(12) United States Patent
Fujiwara

(10) Patent No.: US 6,969,791 B2
(45) Date of Patent: Nov. 29, 2005

(54) AUTOMATIC PLAYER KEYBOARD MUSICAL INSTRUMENT EQUIPPED WITH KEY SENSORS SHARED BETWEEN AUTOMATIC PLAYING SYSTEM AND RECORDING SYSTEM

(75) Inventor: Yuji Fujiwara, Shizuoka-ken (JP)

(73) Assignee: Yamaha Corporation, (JP)

( * ) Notice: Subject to any disclaimer, the term of this patent is extended or adjusted under 35 U.S.C. 154(b) by 39 days.

(21) Appl. No.: 10/794,054

(22) Filed: Mar. 8, 2004

(65) Prior Publication Data

US 2005/0211048 A1 Sep. 29, 2005

(51) Int. Cl.[7] ..... G10F 1/02
(52) U.S. Cl. ..... 84/13
(58) Field of Search ..... 84/600–602, 622, 84/718, 720, 723, 735, 743–745, 13, 17–21

(56) References Cited

U.S. PATENT DOCUMENTS

| | | | | |
|---|---|---|---|---|
| 5,210,367 A | | 5/1993 | Taguchi et al. | |
| 5,652,399 A | * | 7/1997 | Fujiwara et al. | 84/21 |
| 5,739,450 A | * | 4/1998 | Fujiwara et al. | 84/462 |
| 5,994,632 A | | 11/1999 | Muramatsu et al. | |
| 6,245,985 B1 | | 6/2001 | Sasaki | |
| 6,420,642 B1 | | 7/2002 | Muramatsu | |

FOREIGN PATENT DOCUMENTS

| | | |
|---|---|---|
| JP | 3-171097 | 7/1991 |
| JP | 10-301561 | 11/1998 |
| JP | 2890557 | 2/1999 |
| WO | WO-01/95308 A1 | 12/2001 |

* cited by examiner

*Primary Examiner*—Kimberly Lockett
(74) *Attorney, Agent, or Firm*—Dickstein, Shapiro, Morin & Oshinsky, LLP.

(57) ABSTRACT

An automatic player piano has various sorts of individuality due to differences in size, design margins applied to the component parts and a difference in electric characteristics of system component parts so that key position signals contain error components due to those sorts of individuality; plural feedback control loops are created between the key sensors and key actuators, and the error components are eliminated from the current key positions through the normalization; even if an original performance is reenacted through the automatic player piano different from that used in the recording, the feedback control loops cause the key actuators to force the keys to move along reference trajectories determined on the basis of the music data codes, whereby the manufacturer makes the key sensors shared between the recording system and the automatic playing system.

18 Claims, 8 Drawing Sheets

AUTOMATIC PLAYER KEYBOARD MUSICAL INSTRUMENT EQUIPPED WITH KEY SENSORS SHARED BETWEEN AUTOMATIC PLAYING SYSTEM AND RECORDING SYSTEM

FIELD OF THE INVENTION

This invention relates to an automatic player piano and, more particularly, to an automatic player piano of the type having a recording system and an automatic playing system.

DESCRIPTION OF THE RELATED ART

The automatic player piano is a combination of an acoustic piano, a recording system and an automatic playing system. The recording system and automatic playing system are installed inside the acoustic piano, and are selectively enabled with user's instructions. The recording system and automatic playing system behave in a recording mode and a playback mode as follows.

While the user is fingering a piece of music on the acoustic piano in the recording mode, the key motion is converted to pieces of positional data, and the pieces of positional data are analyzed for extracting pieces of characteristic data representative of the key motion. The pieces of characteristic data are memorized in music data codes. Thus, the performance on the acoustic piano is recorded in a set of music data codes by the recording system.

When the user wishes to reproduce the performance, he or she instructs the automatic playing system to access the set of music data codes. The automatic playing system sequentially reads out the music data codes, and anamatic playing system sequentially reads out the music data codes, and analyzes them so as to determine the key motion to be reenacted. Upon completion of the analysis, driving signals are supplied to solenoid-operated key actuator units, which are provided under the rear portions of the black and white keys, so that the black and white keys are sequentially moved as if the player fingers the piece of music on the acoustic piano, again. Thus, the automatic playing system reenacts the original performance in the playback mode.

Since the music data codes are produced on the basis of the pieces of positional data representative of the current key positions, position transducers are required for the black and white keys. An array of position transducers, which are referred to as "key sensors", is provided under the front portions of the black and white keys, and the key sensors convert the current key positions to electric signals. Thus, the key sensors are indispensable for the recording system.

The key motion is neither uniform nor constant. The player depresses the black and white keys at different force. The player may change the force on the way toward the end positions. The different sorts of key motion result in the piano tones at different loudness. For this reason, the automatic playing system is expected to render the black and white keys reenact the original key motion. However, the individuality is unavoidable in both of the array of the solenoid-operated key actuator units and the array of the black and white keys. Even if the solenoid-operated key actuator units are energized with a predetermined amount of driving signal, it is rare that the associated black and white keys take the key motion strictly same as the original key motion. In order to render the black and white keys strictly reenact the original key motion, the servo-control is preferable to the simple control without any feedback loop. Position transducers are required for the solenoid-operated key actuator units. In fact, the high-class automatic player pianos have the arrays of solenoid-operated key actuator units with built-in plunger sensors for the feedback control. However, the solenoid-operated key actuator units with the built-in plunger sensors are costly. For this reason, the built-in plunger sensors are omitted from the solenoid-operated key actuator units for the standard automatic player pianos.

A typical example of the solenoid-operated key actuator unit with a built-in plunger sensor is disclosed in Japanese Patent Application laid-open No. Hei 10-301561. The prior art solenoid-operated key actuator unit includes a solenoid, a plunger and a plunger sensor. The plunger is projectable from and retractable into the solenoid as similar to the standard solenoid-operated key actuator. The plunger sensor includes a permanent magnet bar coaxially fixed to the plunger and a coil wound around the permanent magnet bar. When the solenoid is energized, the plunger projects from the solenoid, and the permanent magnet bar is moved together with the plunger. While the permanent magnet bar is being moved, potential is induced in the coil. The induced potential is dependent on the velocity of the plunger, and is reported to the controller. The controller analyzes the potential, and determines the velocity of the plunger.

A typical example of the servo-controlling method is disclosed in Japanese Patent No. 2890557. The controller determines a target key motion, that is, a series of target key positions for a black and white key to be moved on the basis of the music data codes, and energizes the solenoid so as to give rise to the target key motion. A feedback sensor converts an actual key position to a detecting signal, and supplies it to the controller. The controller compares the actual key motion with the target key motion, and changes the driving signal, with which the solenoid-operated key actuator unit is being energized, in such a manner that the difference between the target key motion and the actual key motion is minimized. Thus, the controller makes the actual key motion closer to the original key motion than the key motion without the servo-control.

The prior art built-in sensor disclosed in Japanese Patent Application laid-open Hei 10-301561 is not used in the prior art servo-controlling method. The feedback sensor used in the prior art servo-controlling method is constituted by the combination of an optical sensor and a piezoelectric converter. The optical sensor is provided on a key bed, and converts the gradient of the key to a detecting signal. On the other hand, the piezoelectric converter is provided between the associated key and the plunger of the solenoid-operated key actuator, and converts the thrust, which is exerted on the key, to another detecting signal. These detecting signals are supplied to the controller. The controller analyzes the gradient and thrust so as to determine the actual key motion. Thus, the feedback sensor disclosed in Japanese Patent No. 2890557 is complicated.

Moreover, although a recording system is referred to in Japanese Patent No. 2890557, the Japanese Patent Specification is silent to the system configuration and, accordingly, what sort of key sensors is incorporated therein. In other words, the optical sensor is only referred to as a part of the feedback sensor.

The automatic playing system with the servo-controlling loop is preferable to the standard automatic playing system, in which the servo-controlling loop is not incorporated, from the viewpoint of the fidelity in the playback. However, the servo-controlling loop is much expensive, and renders the production cost of the automatic player piano high. Thus, there is a trade-off between the fidelity of the playback and the production cost of the automatic player piano.

SUMMARY OF THE INVENTION

It is therefore an important object of the present invention to provide a keyboard musical instrument with an automatic playing system which is economical without sacrifice of the fidelity in playback.

The present inventor contemplated the problem inherent in the prior art automatic player piano, and noticed that lots of feedback sensors, which were usually eighty-eight sets of the optical sensors/piezoelectric converters, were incorporated in the servo-controlling loop.

First, the present inventor replaced the prior art feedback sensors with the built-in sensors disclosed in Japanese Patent Application laid-open hei 10-301561. The number of component parts was surely decreased, and the production cost was reduced. However, not only the automatic playing system but also the recording system were incorporated in several models of the automatic player piano. In those models, the eight—eight key sensors were further required for the automatic player piano, and the total number of sensors was doubled. For this reason, the automatic player piano with both systems was still expensive.

In order further to reduce the production cost, the present inventor thought it effective against the increase of the production cost to share the built-in plunger sensors between the automatic playing system and the recording system. However, the heads of the plungers were to be physically separated from the rear portions of the depressed black and white keys in the playback. This was because of the fact that the plunger heads were usually irregular in height. The gap absorbed the irregularity. Even though the plungers were regulated to a certain height, the plungers were to be tied to the associated keys during the recording. When a user depressed the front portions of the black and white keys in the recording mode, the rear portions, which were assumed to be untied to the plungers, were lifted over the heads of the plungers, and the key motion was not transmitted to the built-in sensors. On the other hand, if the heads of the plungers were tied to the rear portions of the black and white keys, the user felt the black and white keys heavier, and the plungers destroyed the unique key touch of the acoustic piano. Thus, it was not feasible to share the built-in sensors between the automatic playing system and the recording system.

It was also difficult to control the solenoid-operated key actuators through feedback loops, which merely contained the key sensors instead of the feedback sensors. In other words, the key position signals did not strictly represent the plunger motion. The reason for the difficulty was that the component parts between the plunger and the key sensor were deformable. For this reason, a time lag was introduced between the plunger motion and the displacement of the front portions of the black and white keys.

To accomplish the object, the present invention proposes to eliminate a sort of individuality inherent in plural motion propagating paths and another sort of individuality inherent in an automatic playing system from current physical quantity expressing a motion of the component parts of the motion propagating paths through a normalization.

In accordance with one aspect of the present invention, there is provided an automatic player keyboard musical instrument for producing tones comprising a keyboard musical instrument including a tone generating sub-system for producing the tones and plural motion propagating paths each having plural component parts connected in series toward the tone generating sub-system and sequentially moved for specifying a pitch of the tone to be produced, an automatic playing system showing an individuality together with the plural motion propagating paths and including plural actuators respectively associated with the plural motion propagating paths and selectively energized with driving signals so as selectively to cause the associated motion propagating paths to move, plural sensors remote from the plural actuators and respectively converting a motion of predetermined component parts of the plural motion propagating paths to detecting signals representative of a current physical quantity expressing the motion and plural feedback control loops connected between the plural sensors and the plural actuators, normalizing the current physical quantity so as to eliminate the individuality from the current physical quantity for determining a true physical quantity and optimizing the driving signals on the basis of the true physical quantity for controlling the motion of the predetermined component parts, and a recording system sharing the plural sensors with the automatic playing system and analyzing the current physical quantity for producing pieces of music data representative of a performance on the keyboard musical instrument.

BRIEF DESCRIPTION OF THE DRAWINGS

The features and advantages of the automatic player keyboard instrument will be more clearly understood from the following description taken in conjunction with the accompanying drawings, in which.

DESCRIPTION OF THE PREFERRED EMBODIMENTS

Figure 1:
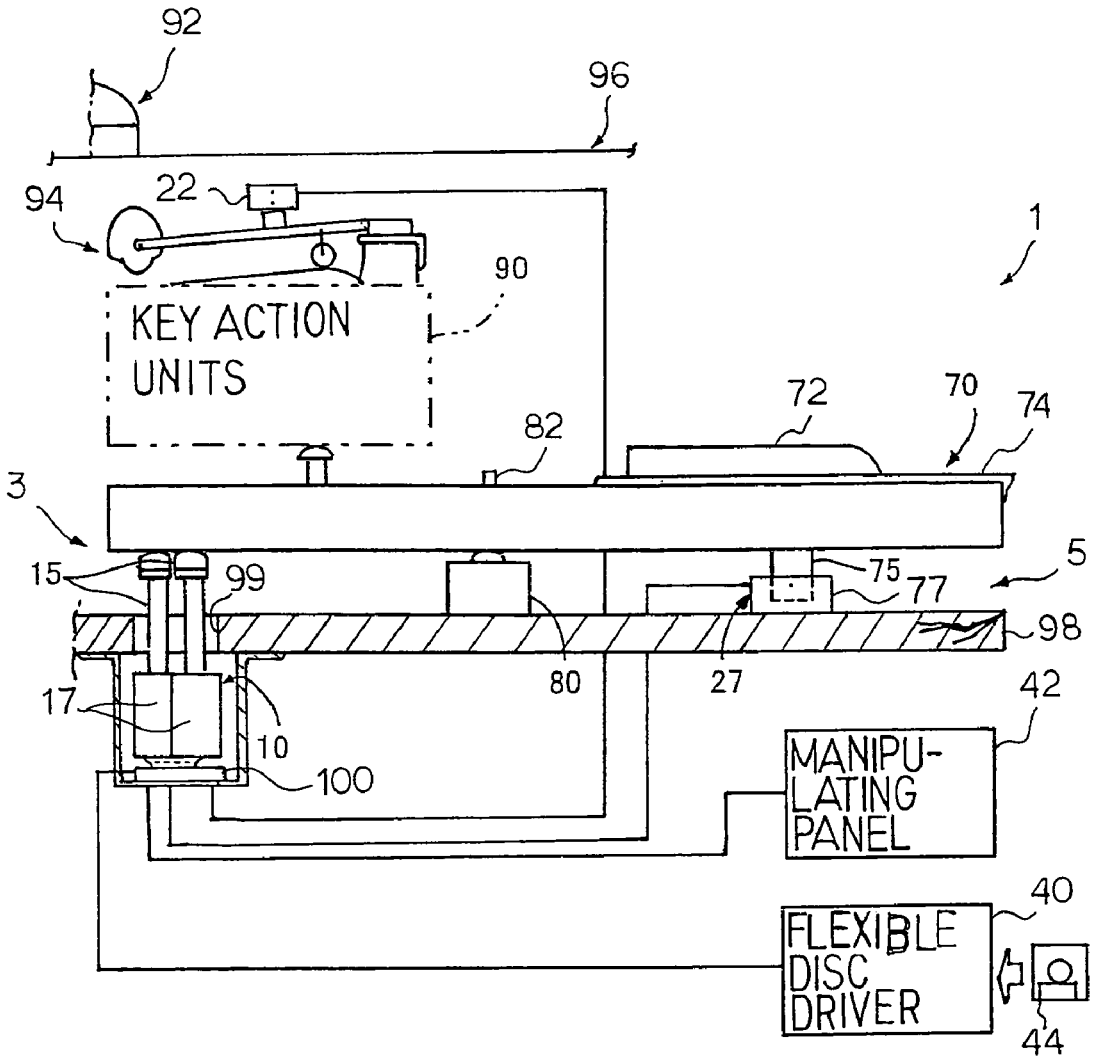
FIG. 1 is a schematic side view showing the structure of an automatic player piano according to the present invention.

An automatic player keyboard musical instrument according to the present invention largely comprises a keyboard musical instrument, a recording system and an automatic playing system. A player fingers a piece of music on the keyboard musical instrument. Then, the keyboard musical instrument generates tones at given pitches. When the player instructs the recording system to record the performance on the keyboard musical instrument, the recording system produces pieces of music data representative of the performance. On the other hand, when the player instructs the automatic playing system to reenact the performance without any fingering on the keyboard musical instrument, the automatic playing system analyzes the pieces of music data, and actuates the keyboard musical instrument so that the performance is reenacted. The keyboard musical instrument, automatic playing system and recording system are hereinafter described in more detail.

The keyboard musical instrument includes a tone generating sub-system for producing tones and plural motion propagating paths connected to the tone generating sub-system. Each of the motion propagating paths has component parts connected in series, and motion of a component part is sequentially propagated through the other component parts to the tone generating sub-system. The plural motion propagating paths have a sort of individuality due to the different in size, a design margin applied to the component parts and/or the material which the component parts are made of.

The keyboard musical instrument is assumed to be an acoustic piano. Plural strings form in combination the tone generating sub-system, and black and white keys, action units and hammers as a whole constitute the plural motion propagating paths. In case where the keyboard musical instrument is a mute piano, the strings and a electronic tone generating system serve as the tone generating sub-system, and the black and white keys, action units and hammers also as a whole constitute the plural motion propagating paths.

While a player is fingering a piece of music on the plural motion propagating paths, his or her fingers selectively give rise to motion in the plural motion propagating paths, and the motion is propagated to the tone generating sub-system for specifying pitches of the tones to be produced. When the motion reaches the tone generating sub-system, the tones are produced at the pitches.

The automatic playing system includes plural actuators, plural sensors and plural feedback control loops. The automatic playing system has another sort of individuality due to the relative position between the plural sensors and the plural motion propagating paths and input-to-output characteristics of the plural sensors. Characteristic differences in component parts of the feedback control loops may be another factor of the individuality. Thus, the automatic playing system shows the individuality together with the motion propagating paths. However, the origins, i.e., the motion propagating paths, sensors and so forth are differently weighted in the individuality. For example, most of the individuality may be due to the plural sensors. Otherwise, the plural sensors may be weighted to zero.

The plural actuators are provided for the plural motion propagating paths, respectively. When the plural actuators are energized, the plural actuators cause the associated motion propagating paths to move. The motion of one of the component parts is propagated through other component parts to the tone generating sub-system so that the tone are produced without any fingering on the keyboard musical instrument.

The plural sensors are remote from the plural actuators. This means that the prior art built-in feedback sensors can not serve as the plural sensors. The plural sensors monitor predetermined component parts of the plural motion propagating paths, and convert current physical quantity, which expresses the motion of the predetermined component parts, to detecting signals. If the individuality of the motion propagating paths has an influence on the motion of the predetermined part, the current physical quantity contains an error component due to the individuality. As will be hereinafter, the feedback control loops also have another sort of individuality, and has an influence on the driving signal. The plural sensors may have another sort of individuality due to the input-and-output characteristics. Since the sensors converts the motion of the predetermined component parts to the detecting signals, the current physical quantity further contains error components due to the other sorts of individuality.

The plural feedback control loops are respectively connected between the plural sensors and the plural actuators. Each of the feedback control loops receives the detecting signal from the associated sensor, and normalizes the current physical quantity. The above-described sorts of individuality, which are parts of the individuality of the automatic playing system/motion propagating paths, are eliminated from the current physical quantity, and true physical quantity is obtained through the normalization. The feedback control loops make the driving signals optimum on the basis of the true physical quantity so that the actuators force the predetermined component parts to move as similar to those in the original performance.

The plural sensors are shared between the automatic playing system and the recording system. The recording system analyzes the current physical quantity, and produces pieces of music data representative of the performance on the keyboard musical instrument. The pieces of music data are stored in a non-volatile memory. Otherwise, the pieces of music data are transferred to another data storage or another musical instrument through a suitable communication cable.

As will be understood from the foregoing description, the feedback control loops eliminate the sorts of individuality from the current physical quantity so that, even if the pieces of music data were produced through another keyboard musical instrument different from the keyboard musical instrument used for the playback, the performance is reenacted at good fidelity.

The sensors are shared between the recording system and the automatic playing system. Any actuator with a built-in feedback sensor is not required for the automatic player keyboard musical instrument. Thus, the production cost is reduced without sacrifice of the fidelity.

First Embodiment

Automatic Player Piano

Referring to FIG. 1 of the drawings, an automatic player piano embodying the present invention largely comprises an acoustic piano 1, an automatic playing system 3 and a recording system 5. The automatic playing system 3 and recording system 5 are installed in the acoustic piano 1, and are selectively activated depending upon the mode of operation. While a player is fingering a piece of music on the acoustic piano 1 without any instruction for recording and playback, the acoustic piano 1 behaves as similar to a standard acoustic piano, and generates the piano tones at the pitches specified through the fingering.

When the player wishes to record his or her performance on the acoustic piano 1, the player gives the instruction for the recording to the recording system 5, and the recording system 5 is activated. While the player is fingering on the acoustic piano, the recording system 5 produces music data codes representative of the fingering on the acoustic piano, and the performance is recorded in a set of music data codes.

A user is assumed to wish to reproduce the performance. The user instructs the automatic playing system 3 to reproduce the acoustic tones. The automatic playing system 3 fingers the piece of music on the acoustic piano 1, and reenacts the piece of music without the fingering of the human player.

In the following description, term "front" is indicative of a position closer to a pianist, who is sitting on a stool for fingering, than another position modified with term "rear". A direction drawn between a front position and a corresponding rear position is referred to as the "fore-and-aft direction", and the lateral direction crosses the fore-and-aft direction at right angle.

Acoustic Piano

In this instance, the acoustic piano 1 is a grand piano. The acoustic piano 1 includes a keyboard 70, action units 90, dampers 92, hammers 94 and strings 96. A key bed 98 forms a part of a piano cabinet, and the keyboard 70 is mounted on the key bed 98. The keyboard 70 is linked with the action units 90 and dampers 92, and a pianist selectively actuates the action units 90 and dampers 92 through the keyboard. The dampers 92, which are selectively actuated through the keyboard 70, are spaced from the associated strings 96 so that the strings 96 get ready to vibrate. On the other hand, the action units 90, which are selectively actuated through the keyboard 70, give rise to free rotation of the associated hammers 94, and the hammers 94 strike the associated strings 96 at the end of the free rotation. Then, the strings 96 vibrate, and the acoustic tones are produced through the vibrations of the strings 96. Thus, the keyboard 70, action units 90, dampers 92, hammers 94 and strings 96 behave as similar to those of a standard acoustic piano.

The keyboard 70 includes plural black keys 72, plural white keys 74 and a balance rail 80. The black keys 72 and white keys 74 are laid on the well-known pattern, and are movably supported on the balance rail 80 by means of balance key pins 82.

A user is assumed to depress the front portions of the black and white keys 72/74. The front portions are sunk toward the key bed 98, and the rear portions are raised. The key motion gives rise to the activation of the associated key action units 90, and causes the strings 96 to get ready for the vibrations as described hereinbefore. The activated action units 90 drive the associated hammers 94 for free rotation through the escape. The hammers 94 strike the associated strings 96 at the end of the free rotation for producing the acoustic tones. The hammers 94 rebound on the strings 96, and are engaged with the key action units 90, again.

When the user releases the black and white keys 72/74, the self-weight of the action units 90 gives rise to the rotation of the black and white keys 72/74 in the counter direction so that the black and white keys 72/74 return to the rest positions. The dampers 92 are brought into contact with the associated strings 96 so that the acoustic tones are decayed. The key action units 90 return to the rest positions, again. Thus, the human pianist can give rise to the angular key motion about the balance rail 80 like a seesaw.

Automatic Playing System

The automatic playing system 3 includes an array of key actuators 10, hammer sensors 22, key sensors 27, a flexible disc driver, which is abbreviated as "FDD", 40, a manipulating panel 42 and a controller 100. As will be described hereinafter in conjunction with the recording system 5, those component parts are shared with the recording system 5 except the array of key actuators 10. In this instance, the key actuators 10 are implemented by solenoid-operated actuator units. The key actuators 10 are independently energized for moving the associated black and white keys 72/74. This means that the key actuators 10 required for the keyboard 70 is equal in number to the black and white keys 72/74. Each of the solenoid-operated key actuator units 10 includes a plunger 15 and a combined structure of a solenoid and yoke 17. The array of solenoid-operated key actuator units 10 is hung from the key bed 98, and the plungers 15 project over the key bed 98 through a slot 99 formed in the key bed 98. While the solenoid-operated key actuator units 10 is standing idle without any driving signal, the plungers 15 are retracted in the combined structure of solenoid and yoke 17, and the tips of the plungers 15 are slightly spaced from the lower surfaces of the black and white keys 72/74 at the rest positions. When the controller 100 energizes the combined structures 17 with the driving signal, magnetic field is created, and the magnetic force is exerted on the plungers 15. Then, the plungers 15 upwardly project from the combined structures 17, and pushes the lower surfaces of the black and white keys 72/74 so as to give rise to the angular motion.

Figure 2:
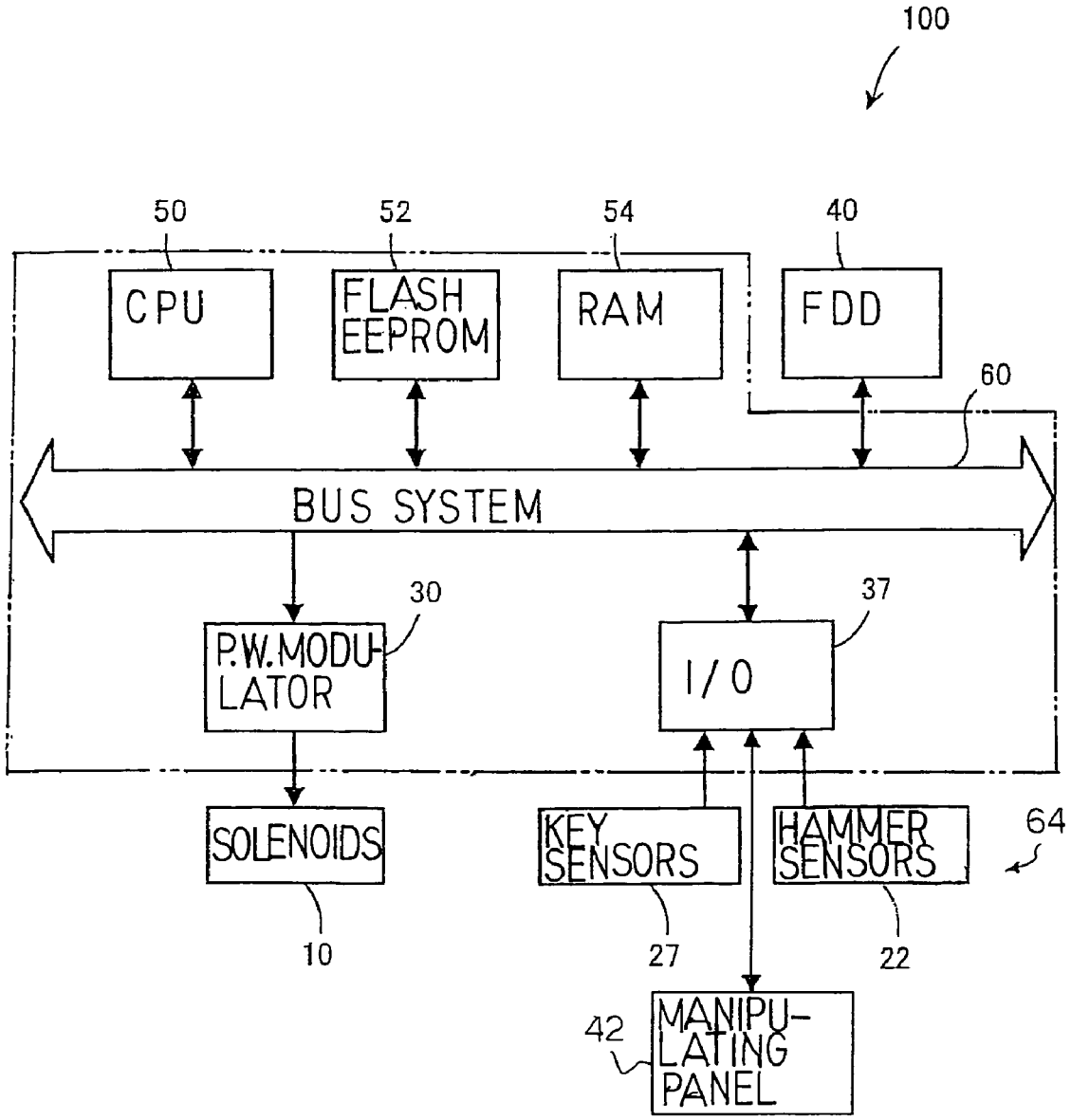
FIG. 2 is a block diagram showing the system configuration of a controller incorporated in the automatic player piano.

FIG. 2 shows the system configuration of the controller 100. The controller 100 includes a pulse width modulator 30, an interface 37, which is abbreviated as "I/O" in the figure, a central processing unit 50, which is abbreviated as "CPU", a flash electrically erasable and programmable read only memory 52, which is abbreviated as "FLASH EEPROM", a random access memory 54, which is abbreviated as "RAM" and a bus system 60. These system components 30, 37, 50, 52 and 54 are connected to the bus system 60, and address codes, control data codes and music data codes are selectively propagated from particular system components to other system components through the bus system 60. The hammer sensors 22, key sensors 27 and manipulating panel 42 are connected to the interface 37, and the pulse width modulator 30 distributes the driving signal to the solenoid-operated key actuators 10. The flexible disc driver 40 is further connected to the bus system 60, and music data codes are transferred between the bus system 60 and the flexible disc driver 40.

The hammer sensors 22 are provided for the hammers 94, respectively, that is, equal in number to the hammers 94, and, accordingly, the black and white keys 72/74. The hammer sensors 22 are stationary, and monitor the associated hammers 94. Each of the hammer sensors 22 includes two photo couplers, that is, the combinations of a light emitting diode and a phototransistor. The light emitting diodes are spaced from each other along the trajectory of a shutter plate attached to the hammer shank of the associated hammer 94, and are opposed to the phototransistors, respectively. Thus, the two pairs of photo couplers bridge the gap, through which the shutter plate is moved, with light beams. One of the photo couplers is located at the end of the trajectory where the shutter plate begins to return due to the rebound of the hammer 94 on the associated string 96. Thus, the timing at which the hammers 94 strike the associated strings 96 is detected with the photo coupler on the downstream side. The other photo coupler is provided on the upstream side, and is spaced by a predetermined distance. While the hammer 94 is rotating, the shutter plate intermittently intersects the light beams. The amount of light received by the phototransistors is rapidly changed, and digital hammer position signals, which the phototransistors produce on the basis of the amount of light received, are sequentially changed from on-state to off-state. The time difference is determined by the controller 100, and the distance between the photo couplers is known. Then, the hammer velocity is calculated by the controller 100. The hammer velocity is proportional to the strength of the impact on the string 96, and the strength of the impact is proportional to the loudness of the acoustic tone. Thus, the controller 100 produces pieces of music data representative of the loudness of an acoustic tone and the time at which the acoustic tone is to be produced on the basis of the hammer position signals.

The key sensors 27 are provided on the key bed 98, and are respectively located below the black and white keys 72/74. In other words, the key sensors 27 are equal in number to the black and white keys 72/74. The key sensors 27 converts current key positions of the associated black and white keys 72/74 to key position signals. Thus, the key sensors 27 serve as position transducers.

Each of the key sensors 27 includes a shutter plate 75, a transparent plate of which is printed with a non-transparent gray scale, and a pair of optical sensor heads 77. A light emitting diode (not shown) is connected to one of the optical sensor heads 77 through an optical fiber (not shown), and laterally radiates a light beam across the trajectory of the shutter plate 75. The other optical sensor head 77 is provided on the other side across the trajectory, and is connected to a phototransistor (not shown) through an optical fiber (not shown). The light beam has a wide cross section so that the shutter plate 75 gradually interrupts the light beam during the downward motion of the associated key 72/74. While the black and white key 72/74 is moving from the rest position toward the end position, the amount of light incident on the phototransistor is gradually reduced, and the current key position is determined on the basis of the amount of light received. Thus, the key sensors 27 produce key position signals representative of the current key positions continuously varied in the downward motion of the associated black and white keys 72/74.

The key sensors 27 are causative of another sort of individuality inherent in the automatic playing system. For example, if the transparent plate is stained, the amount of light passing therethrough is unintentionally reduced. When the shutter plate is offset from the target position on the lower surface of the associated key, when the sensor heads are offset from the target positions on the key bed, the light intensity is varied on the phototransistors. The aged deterioration is unavoidable in the light emitting diodes and phototransistors. The bias voltage is, by way of example, varied with time. The light emitting diodes and phototransistors are supplied with electric power from a suitable power source. The power source can not perfectly protect the power voltage from undesirable potential fluctuation. These are other factors of the other sort of individuality. Of course, those factors are not evenly weighted. Some factors may be ignoreable, and another factor is serious.

The key sensors 27 produce the key position signals in both of the playback and recording. While the controller 100 is being active for recording the performance, the black and white keys 72/74 are selectively depressed and released by a human player, and the unique key motion is converted to current key positions continuously varied. The analog key position signals are converted to digital key position signals also continuously varied in binary value by means of analog-to-digital converters. On the other hand, while the controller 100 is being active for a playback, the key sensors 27 serve as the feedback sensors, and the controller 100 checks the key position signals to see whether or not the key actuators 10 give rise to target key motion. If the actual key motion is different from the target key motion, the driving signals are modified so as to make the actual key motion consistent with the target key motion.

The key position signals and hammer position signals reach the interface 37. The interface 37 appropriately reshapes the waveform of the hammer position signals and the key position signals, and, thereafter, converts the hammer position signals and key position signals to digital hammer position signals and digital key position signals by means of an analog-to-digital converter (see FIG. 3). The interface 37 is further connected to the flexible disc driver 40, and music data codes are transferred through the interface 37 to and from the flexible disc driver 40. A set of music data codes, which represents a performance on the keyboard 70, is written in a floppy disc 44 by means of the flexible disc driver 40 in the recording, and is read out from the floppy disc 44 through the flexible disc driver 40 in the playback.

The manipulating panel 42 is further connected to the interface 37. Plural button switches, a display window and indicators are provided on the manipulating panel 42. One of the button switches makes the controller 100 powered. Users give various instructions to the controller 100 through other button switches, and select a piece of music to be reproduced through another button switch. When a user wishes to record his or her performance, the user instructs the controller 100 to enter the recording mode through the manipulating panel 42. When the user wishes to reenact the performance, the user also instructs the controller to enter the playback mode through the manipulating panel 42. Thus, the manipulating panel 42 is a man-machine interface.

The pulse width modulator 30 serves as a driver for the key actuators 10 in the playback. The thrust of the plungers 15 is varied with the driving signals. In this instance, the pulse width modulator 30 changes the duty ratio of the driving signals for varying the thrust of the plungers 15. When the actual key motion is noticed to be late, the pulse width modulator 30 increases the duty ratio of the driving signals. On the other hand, if the black and white keys 72/74 are moved in advance, the pulse width modulator 30 decreases the duty ratio so that the plungers 15 are decelerated.

In this instance, the central processing unit 50, pulse width modulator 30, key actuators 10, key sensors 27 and interface 37 forms a feedback control loop 64, and the black and white keys 72/74 are inserted into the feedback control loop 64.

A main routine program, sub-routine programs and parameter tables are stored in the flash electrically erasable and programmable memory 54, and the random access memory 54 serves as a working memory for the central processing unit 50. The central processing unit 50 runs on the main routine program, and the main routine program selectively branches to the sub-routine programs. The behavior in the playback mode will be hereinafter described.

Recording System and Behavior in Recording Mode

The recording system 5 includes the key sensors 27, hammer sensors 22, flexible disc driver 40, manipulating panel 42 and controller 100. Thus, the recording system 5 shares the system components 22, 27, 40, 42, 100 with the playback system 3.

When a user instructs the controller 100 to record his or her performance through the manipulating panel 42, the central processing unit 50 starts to run on the main routine program, and periodically enters the subroutine program for recording the performance. The central processing unit 50 starts an internal clock for measuring the lapse of time.

In the subroutine program, the central processing unit 50 fetches the pieces of music data representative of the current hammer positions and the pieces of music data representative of the current key positions, and accumulates those pieces of music data in the random access memory 54. Subsequently, the central processing unit 50 compares the current key positions with the previous key positions to see whether or not the user depresses or releases any one of the black and white keys 72/74.

If the central processing unit 50 notices the user depress one of the black and white keys 72/74, the central processing unit 50 acknowledges a key-on event, and specifies the depressed key 72/74. The shutter plate attached to the hammer 94 is assumed to intersect the light beam of the downstream photo coupler after the key-on event. The central processing unit 50 calculates the hammer velocity, and determines the lapse of time from the initiation of the performance or the previous event to the note-on event. The central processing unit 50 produces a note-on event code and a duration code, and stores the pieces of music data representative of the key code assigned to the depressed key, hammer velocity and the lapse of time in the note-on event code and duration code. The note-on event code and duration code are different sorts of music data codes. The note-on event code is accompanied with the duration code.

If, on the other hand, the central processing unit 50 notices the user release the depressed key, the central processing unit 50 specifies the released key 72/74, and determines the timing at which the acoustic tone is to be decayed. The timing is approximately equal to the timing at which the damper 92 is brought into contact with the vibrating string 96. The central processing unit 50 determines the lapse of time from the previous event and the timing at which the acoustic tone is to be decayed. The central processing unit produces a note-off event code and a duration code, and stores the pieces of music data representative of the key code and the lapse of time in the note-off event code and duration code. The note-off event code is another sort of music data code, and is accompanied with the duration code. Term "event code" hereinafter stands for both of the note-on event code and note-off event code.

Though not shown in the drawings, the automatic player piano further includes damper, soft and sostenuto pedals and associated pedal sensors, and the central processing unit 50 also accumulates pieces of music data representative of the current pedal positions in the random access memory 54. When the central processing unit 50 acknowledges that the user steps on the pedal, the central processing unit produces a music data code representative of the effect.

While the user is fingering a piece of music on the keyboard 70, the central processing unit 50 periodically enters the subroutine program, and returns to the main routine program so that the music data codes are intermittently produced and accumulated in the random access memory 54. Upon completion of the performance, the user may instruct the central processing unit 50 to transfer the set of music data codes representative of the performance. If so, the central processing unit 50 transfers the set of music data codes from the random access memory 54 to the flexible disc driver 40, and are stored in the floppy disc 44.

System Behavior in Playback Mode

The user is assumed to instruct the central processing unit 50 to reenact the performance on the basis of the set of music data codes. The central processing unit 50 instructs the flexible disc driver 40 to transfer the set of music data codes to the random access memory 54. Upon completion of the data transfer from the floppy disc 44 to the random access memory 54, the central processing unit 50 starts the internal clock. The central processing unit 50 periodically enters another subroutine program for the playback, and returns to the main routine program upon completion of the tasks in the sub-routine program.

When the central processing unit 50 enters the subroutine program, the central processing unit 50 compares the duration codes with the internal clock to see whether or not any event code or codes are to be processed. If the central processing unit 50 can not find any duration code indicative of the lapse of time equal to that of the internal clock, the central processing unit 50 immediately returns to the main routine program, and enters the subroutine program, again, thereby waiting for the change to the positive answer.

When the central processing unit 50 finds a duration code indicative of the lapse of time equal to that of the internal clock, the central processing unit 50 starts to determine a reference trajectory for the black and white key 72/74 specified by the event code. A method for determining the reference trajectory is described in Japanese Patent Application laid-open No. hei-301561. A target position "rx" on the reference trajectory at time "t" is expressed by the following equation $$rx=f(vm)*t+rx0 \qquad \text{Equation 1}$$

where vm is a velocity in uniform motion of the key 72/74, f(vm) is a gradient at the target position rx, * is the multiplication sign and rx0 is the initial value. The gradient f(vm) is expressed by an exponential function, and is calculated or read out from a table.

Subsequently, the central processing unit 50 determines the initial value of the duty ratio, and supplies a piece of control data representative of the initial value to the pulse width modulator 30. Then, the pulse width modulator 30 produces the driving signal at the given duty ratio, and supplies the driving signal to the solenoid 17 of the key actuator 10 for the black and white key 72/74 to be moved. The magnetic field is created through the combined structure 17 of the solenoid and yoke, and the plunger 15 starts to project.

The plunger 15 gives rise to the rotation of the associated black and white key 72/74, and the shutter plate 75 is downwardly moved. The associated key sensor 27 converts the current key position to the key position signal, and the key position signal is supplied to the interface 37 for the feedback control. The analog key position signal is converted to the digital key position signal, and the piece of positional data, i.e., the binary value of the digital key position signal is fetched by the central processing unit 50.

The central processing unit 50 eliminates error components from the key position represented by the digital key position signal. Then, the key position is normalized, and the actual key position is determined. The central processing unit 50 compares the target position with the actual key position to see whether or not the plunger 15 is to be accelerated or decelerated. When the difference between the target position and the actual key position is ignoreable, the central processing unit 50 instructs the pulse width modulator 30 to keep the duty ratio at the previous value. However, if the difference exceeds an allowable range, the central processing unit 50 supplies a piece of control data representative of another value of the duty ratio to the pulse width modulator 30. Then, the pulse width modulator 30 changes the duty ratio to the new value so that the thrust is increased or decreased. The central processing unit 50 calculates the next target position on the reference trajectory, and waits for the actual key position.

The algorithm is repeated through the feedback control loop 64, and the plunger 15 is forced to move along the reference trajectory. Thus, the original key motion is exactly reproduced so that the performance is reenacted at high fidelity.

Figure 3:
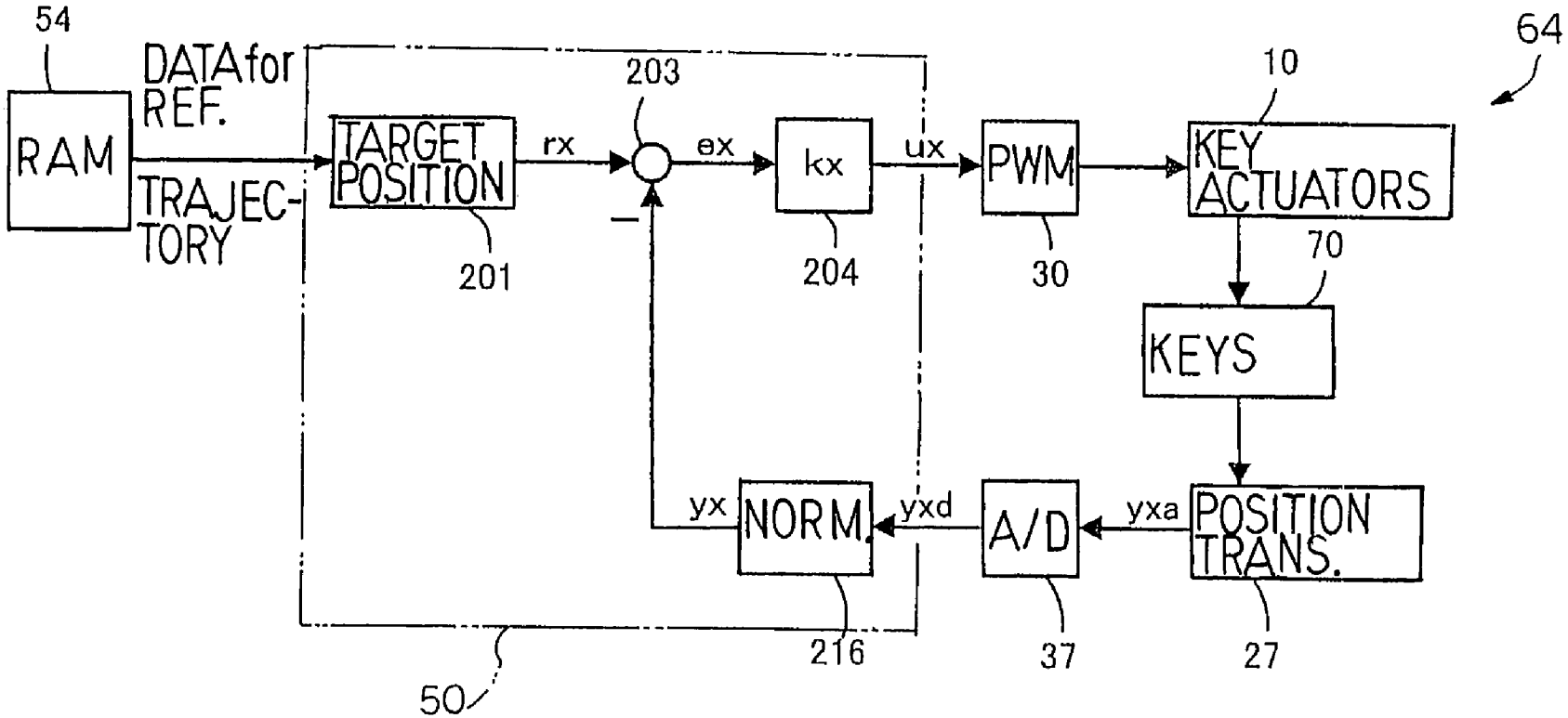
FIG. 3 is a block diagram showing the algorithm employed in a feedback control loop incorporated in the automatic player piano.

FIG. 3 shows the algorithm employed in the feedback control loop 64. The central processing unit 50 realizes the function expressed by boxes 201, 203, 204 and 216 through the execution on the subroutine program.

Assuming now that the plunger 15 has already started to project, the key sensor 27 converts the current key position "yxa" to the key position signal, and supplies the current key position signal to the interface 37. The current key position is normalized to the true key position "yx" as by box 216. The normalization will be hereinlater described in detail.

The central processing unit 50 fetches the piece of normalized positional data representative of the actual key position "yx", and subtracts the true key position "yx" from the target position "rx", which has been already calculated, as by circle 203. The difference "ex" is multiplied by positional gain "kx" as by box 204. The product "ux" is indicative of an increment or a decrement of the mean driving current, that is, an increment or a decrement of a target value of the duty ratio to which the pulse width modulator 30 adjusts the driving signal. The piece of control data representative of the increment/decrement of the target duty ratio "ux" is supplied to the pulse width modulator 30, and the pulse with modulator 30 adjusts the driving signal to the target duty ratio.

The strength of the magnetic field is varied depending upon the target duty ratio, and the thrust, which is exerted on the plunger 15, is also varied. This results in that the plunger 15 is decelerated, accelerated or maintained. Although the force, which is exerted on the associated black and white key 72/74, is varied, the key motion does not immediately follow. A time lag occurs between the change of the thrust and the change of the key motion, and is dependent on the individualities of the keyboard 70 and the individualities of the associated key sensor 27. For this reason, even though the key sensor 27 exactly converts the current key position "yxa" to the analog key position signal, the change of the current plunger position is not exactly transferred to the current key position "yxa". The analog key position signal is converted to the digital key position signal, and the current key position "yxa" is expressed by the binary value "yxd".

The central processing unit 50 fetches the piece of positional data or the binary value "yxd" from the interface 37, and normalizes the current key position as by box 216. Equation 2 is used in the normalization.

$$yx=R*yxd+S \qquad \text{Equation 2}$$

where yx is the normalized key position, R is a calibration factor for a gain at box 204, * is the multiplication sign and S is a calibration factor for the installation error of the key sensor 27.

The normalized key position yx is expressed as $$yx=\{(yxd-YXDr)/(YXDe-YXDr)\}*STR \qquad \text{Equation 2a}$$

where YXDr is the binary value of the digital key position signal at the rest position, YXDe is the binary value of the digital key position signal at the end position and STR is the stroke of the key. The calibration factors R and S are expressed as $$R=STR/(YXDe-YXDr) \qquad \text{Equation 2b}$$

$$S=(-YXDr*STR)/(YXDe-YXDr) \qquad \text{Equation 2c}$$

(3) variation in the error in the manufacturing of the component parts of the motion propagating paths, the influence of which results in a difference in the stroke STR, and (4) offset installation of the key sensors.

The other calibration factor S is effective against the errors due to (1) fluctuation of the power voltage, and (2) offset installatoin of the shutter plate 75.

These calibration factors R and S are experimentally determined for each of the black and white keys 72 and 74, and the experimental values are stored in the flash electrically erasable and programmable read only memory 52.

The central processing unit 50 reads out the pieces of control data such as, for example, the gradient f(vm) and the initial position rxo from the random access memory 54, and calculates the next target position "rx" as by box 201. Thus, the central processing unit 50 periodically checks the true target position "rx" to see whether or not the duty ratio, i.e., the thrust exerted on the plunger 15 is proper to force the plunger to move on the reference trajectory through the above-described feedback control loop 64. As a result, the pulse width modulator 30 can always adjust the driving signal to the optimum duty ratio.

The central processing unit 50 sequentially processes the event codes, and determines the reference trajectories for the black and white keys 72/74 along the music passage. The associated key actuators 10 are controlled through the feedback control loop 64, and the black and white keys 72/74 are moved as similar to those in the original performance. Thus, the original performance is reenacted through the automatic playing system 3.

Although the key sensors 27 are shared between the recording system 5 and the automatic playing system 3, the automatic playing system 3 exactly controls the key motion by virtue of the normalization. Any built-in feedback sensor is not required for the feedback control loop 64. The standard solenoid-operated key actuators are employable in the automatic playing system 3. For this reason, the automatic playing system 3 and, accordingly, the automatic player piano are reduced in production cost without sacrifice of the fidelity of the reproduced performance.

Second Embodiment

Figure 4:
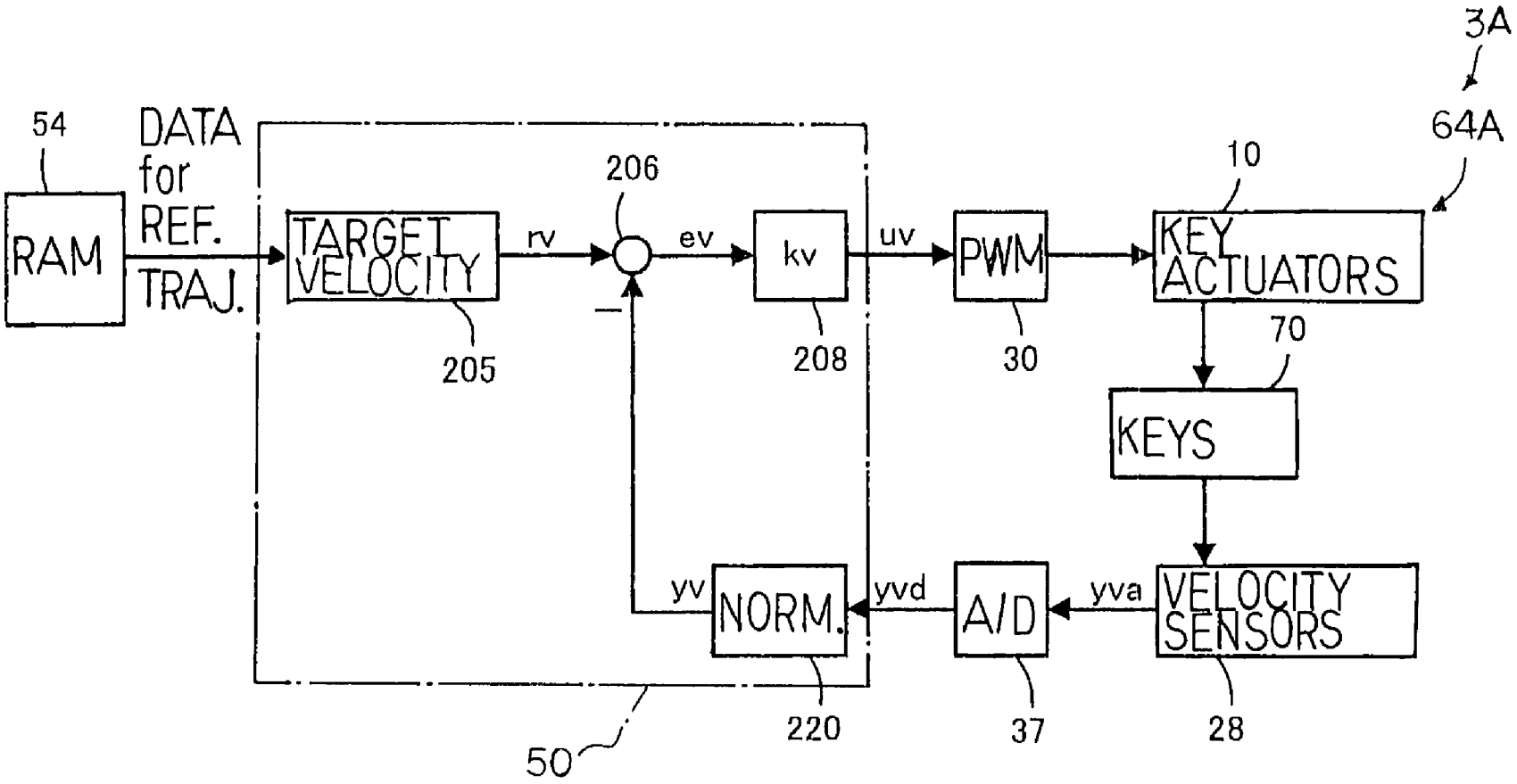
FIG. 4 is a block diagram showing the algorithm employed in a feedback control loop incorporated in another automatic player piano.

FIG. 4 shows the algorithm employed in a feedback control loop 64A incorporated in another automatic player keyboard musical instrument embodying the present invention. The automatic player keyboard musical instrument also comprises an acoustic piano, a recording system and an automatic playing system 3A. The acoustic piano is similar to the acoustic piano 1. The key sensors for the second embodiment are implemented by velocity sensors 28, and, accordingly, the subroutine programs and feedback loop 64A are slightly different from those of the automatic playing system 3 and recording system 5. The differences in the subroutine programs are apparent to persons skilled in the art, and no further description is hereinafter incorporated. In this instance, the velocity sensors 28 are of a non-contact type, that is, the type not physically held in contact with the black and white keys 72/74. Description is hereinafter focused on the feedback loop 64A. The system components of the automatic playing system 3A are hereinafter labeled with the references designating the corresponding system components of the automatic playing system 3.

The central processing unit 50, pulse width modulator 30, key actuators 10, keyboard 70, velocity sensors 28 and interface 37 form the feedback loop 64A. The velocity sensors 28 converts the key velocity to key velocity signals, which represents a current key velocity "yva", and are the key velocity signals are supplied to the interface 37. The analog key velocity signals are converted to digital key velocity signals through the analog-to-digital converters in the interface 37. The central processing unit 50 realizes the function expressed by boxes 205, 206, 208 and 220 through the execution on the subroutine program. The functions at boxes 205, 206, 208 and 220 are described as follows.

Assuming now that the plunger 15 has already started to project, the velocity sensor 28 determines a current key velocity "yva", and supplies an analog key velocity signal to the interface 37. The analog key velocity signal is converted to a digital key velocity signal representative of the binary code "yvd", the binary number of which is equivalent to the magnitude of the analog key velocity signal. The piece of velocity data, i.e., binary code "yvd" is fetched by the central processing unit 50, and the piece of velocity data "yvd" is normalized to a true key velocity "yv" as by box 220. The normalization will be hereinlater described in detail.

The central processing unit 50 fetches the piece of normalized velocity data "yv" representative of the true key velocity, and subtracts the true key velocity "yv" from the target key velocity "ry", which has been already calculated, as by circle 206. The target key velocity "rv" is determined through a differentiation as $$rv=d(rx)/dt=f(vm) \qquad \text{Equation 3}$$

where rx is the target position (see Equation 1). The difference "ev" is multiplied by velocity gain "kv" as by box 208. The product "uv" is indicative of an increment or a decrement of the mean driving current, that is, an increment or a decrement of a target value of the duty ratio to which the pulse width modulator 30 adjusts the driving signal. The piece of control data representative of the increment/decrement of the target duty ratio "uv" is supplied to the pulse width modulator 30, and the pulse with modulator 30 adjusts the driving signal to the target duty ratio.

The strength of the magnetic field is varied depending upon the target duty ratio, and the thrust, which is exerted on the plunger 15, is also varied. This results in that the plunger 15 is decelerated, accelerated or maintained in velocity. Although the force, which is exerted on the associated black and white key 72/74, is varied, the key motion does not immediately follow. A time lag occurs between the change of the thrust and the change of the key motion, and is dependent on the individualities of the keyboard 70 and the individualities of the associated velocity sensor 28. For this reason, even though the velocity sensor 28 exactly converts the current key velocity "yva" to the analog key velocity signal, the change of the current plunger velocity is not exactly transferred to the current key velocity "yva". The analog key velocity signal is converted to the digital key velocity signal, and the current key velocity "yva" is expressed by the binary code "yvd".

The central processing unit 50 fetches the piece of velocity data or the binary value "yvd" from the interface 37, and normalizes the current key velocity as by box 220. Equation 4 is used in the normalization.

$$yv=P*yvd+Q \qquad \text{Equation 4}$$

where yv is the normalized key velocity or true key velocity, P is a calibration factor for a gain, * is the multiplication sign and Q is a calibration factor for an offset due to the installation error of the velocity sensor 28 and so forth. The multiplication with the calibration factor P compensates the current key velocity yvd for the errors described in conjunction with calibration factor R, and the current key velocity yxd is further compensated for the error also described in conjunction with the calibration factor S. These calibration factors P and Q are experimentally determined for each of the black and white keys 72 and 74, and the experimental values are stored in the flash electrically erasable and programmable read only memory 52.

The central processing unit 50 reads out the pieces of control data, and differentiates the target position rx. In other words, the central processing unit 50 calculates the next target velocity "rv" as by box 205. Thus, the central processing unit 50 periodically checks the true key velocity to see whether or not the duty ratio, i.e., the thrust exerted on the plunger 15 is proper to force the plunger 15 to move on the reference trajectory. For this reason, the pulse width modulator 30 can always adjust the driving signal to the optimum duty ratio.

The central processing unit 50 sequentially processes the event codes, and determines the reference trajectories for the black and white keys 72/74 along the music passage. The associated key actuators 10 are controlled through the feedback control loop 64A, and the black and white keys 72/74 are moved as similar to those in the original performance. Thus, the original performance is reenacted through the automatic playing system 3A.

Although the velocity sensors 28 are shared between the recording system and the automatic playing system 3A, the automatic playing system 3A exactly controls the key motion by virtue of the normalization. Any built-in feedback sensor is not required for the feedback control loop 64A. The standard solenoid-operated key actuators 10 are employable in the automatic playing system 3A. For this reason, the automatic playing system 3A and, accordingly, the automatic player keyboard musical instrument are reduced in production cost without sacrifice of the fidelity of the reproduced performance.

Third Embodiment

Figure 5:
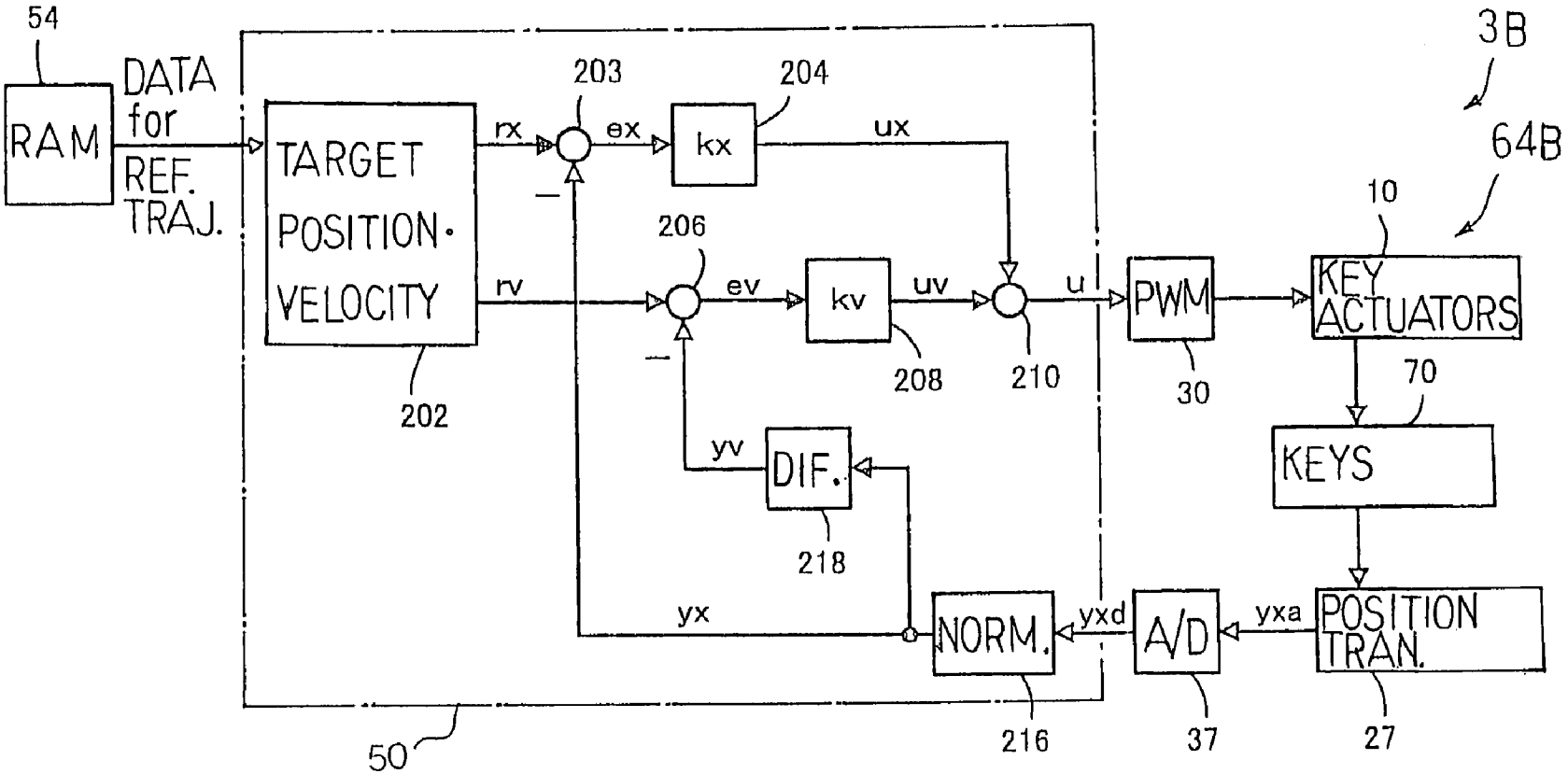
FIG. 5 is a block diagram showing the algorithm employed in a feedback control loop incorporated in yet another automatic player piano.

FIG. 5 shows the algorithm employed in a feedback control loop 64B incorporated in yet another automatic player keyboard musical instrument embodying the present invention. The automatic player keyboard musical instrument also comprises an acoustic piano, a recording system and an automatic playing system 3B. The acoustic piano and recording system are similar to the acoustic piano 1 and recording system 5, and the position transducers 27 are used in the recording system and automatic playing system 3B. However, the subroutine program for the playback mode and feedback loop 64B are different from those of the automatic playing system 3. For this reason, description is hereinafter focused on the feedback loop 64B. The system components of the automatic playing system 3B are hereinafter labeled with the references designating the corresponding system components of the automatic playing system 3 without detailed description.

The central processing unit 50, pulse width modulator 30, key actuators 10, keyboard 70, position transducers 27 and interface 37 form the feedback loop 64B. The position transducers 27 convert the current key position "yxa" to the analog key position signals, and the analog key position signals are supplied to the interface 37. The central processing unit 50 realizes the function expressed by boxes 202, 203, 204, 206, 208, 210, 216 and 218 through the execution on the subroutine program. In this instance, the true key velocity yv is calculated on the basis of the true key position, and the true key position and true key velocity are respectively compared with the target key position and target key velocity for determining an increment or a decrement of a target duty ratio. The functions at circle 203 and box 204 are same as those of the first embodiment, and the functions at circuit 206 and box 208 are same as those of the second embodiment. Thus, the feedback loop 64B is a composite of the feedback loops 64 and 64A. The functions at boxes 202, 203, 204, 206, 208, 210, 216 and 218 are described as follows.

Assuming now that the plunger 15 has already started to project, the position transducer 27 determines the current key position "yxa", and supplies the analog key position signal to the interface 37. The analog key position signal is converted to a digital key position signal representative of the binary code "yxd", the binary number of which is equivalent to the magnitude of the analog key position signal. The piece of positional data, i.e., binary code "yxd" is fetched by the central processing unit 50, and the piece of positional data "yvd" is normalized to a true key position "yx" as by box 216. The normalization is the same process as that of the first embodiment. However, when the designer determines the calibration factor for the gain, he or she takes the amplifications at boxes 204 and 208 into account.

The central processing unit 50 fetches the piece of normalized positional data "yx" representative of the true key position, and calculates a true key velocity "yv" through a differentiation on the true key positions "yx" as follows.

$$yv=(yx0-yx1)/T[\text{mm/sec.}] \qquad \text{Equation 5}$$

where yx0 is the current true key position and yx1 is the previous true key position.

The central processing unit 50 subtracts the true key position "yx" and true key velocity "yv" from the target key position "rx" and target key velocity "ry", which have been already calculated, as by circles 203 and 206. The target key position "rx" and target key velocity "rv" are calculated through Equations 1 and 3, respectively.

The differences "ex" and "ev" are respectively multiplied by the gains "kx" and "kv" as by boxes 204 and 208. The products "ux" and "uv" are indicative of increments/decrements of the mean driving current, that is, the increments/decrements of the target values of the duty ratio from different aspects. The piece of control data representative of the increments/decrements the target values of the duty ratio "ux" and "uv" are supplied to an adder 210, and are added to each other. The sum "u" is indicative of an increment or a decrement of a target value of the duty ratio, to which the pulse width modulator 30 is to be adjusted. The sum "u" is supplied to the pulse width modulator 30, and the pulse with modulator 30 adjusts the driving signal to the target duty ratio.

The strength of the magnetic field is varied depending upon the target duty ratio, and the thrust, which is exerted on the plunger 15, is also varied. This results in that the plunger 15 is decelerated, accelerated or maintained in velocity. Although the force, which is exerted on the associated black and white key 72/74, is varied, the key motion does not immediately follow. A time lag occurs between the change of the thrust and the change of the key motion, and is dependent on the individualities of the keyboard 70 and the individualities of the associated key sensor 27. For this reason, even though the position transducer 27 exactly converts the current key position "yxa" to the analog key position signal, the change of the current plunger position is not exactly transferred to the current key position "yxa". The analog key position signal is converted to the digital key position signal, and the current key position "yxa" is expressed by the binary code "yxd".

The central processing unit 50 fetches the piece of positional data or the binary value "yxd" from the interface 37, and normalizes the current key position as by box 216. The normalization proceeds as similar to the normalization expressed by Equation 2. The true key position "yx" is calculated through the differentiation (see Equation 5). Thus, the central processing unit 50 prepares the true key position "yx" and true key velocity "yv". The central processing unit 50 reads out the pieces of control data, and calculates the next target position "rx" and next velocity "rv" as by box 202. The differences "ex" and "ev" are calculated, and, finally, the target duty ratio is determined as described hereinbefore. Thus, the central processing unit 50 periodically checks the true key position "yx" and true key velocity "yv" to see whether or not the duty ratio, i.e., the thrust exerted on the plunger 15 is proper to force the plunger 15 to move on the reference trajectory through the above-described feedback control loop 64B. For this reason, the pulse width modulator 30 can always adjust the driving signal to the optimum duty ratio.

The central processing unit 50 sequentially processes the event codes, and determines the reference trajectories for the black and white keys 72/74 along the music passage. The associated key actuators 10 are controlled through the feedback control loop 64B, and the black and white keys 72/74 are moved as similar to those in the original performance. Thus, the original performance is reenacted through the automatic playing system 3B.

Although the position transducers 27 are shared between the recording system and the automatic playing system 3B, the automatic playing system 3B exactly controls the key motion by virtue of the normalization. Any built-in feedback sensor is not required for the feedback control loop 64B. The standard solenoid-operated key actuators 10 are employable in the automatic playing system 3B. For this reason, the automatic playing system 3B and, accordingly, the automatic player keyboard musical instrument are reduced in production cost without sacrifice of the fidelity of the reproduced performance.

In this instance, the feedback loop 64B controls the duty ratio of the driving signal through both differences "ex" and "ev". For this reason, the pulse width modulator 30 controls the plunger motion more precisely.

Fourth Embodiment

Figure 6:
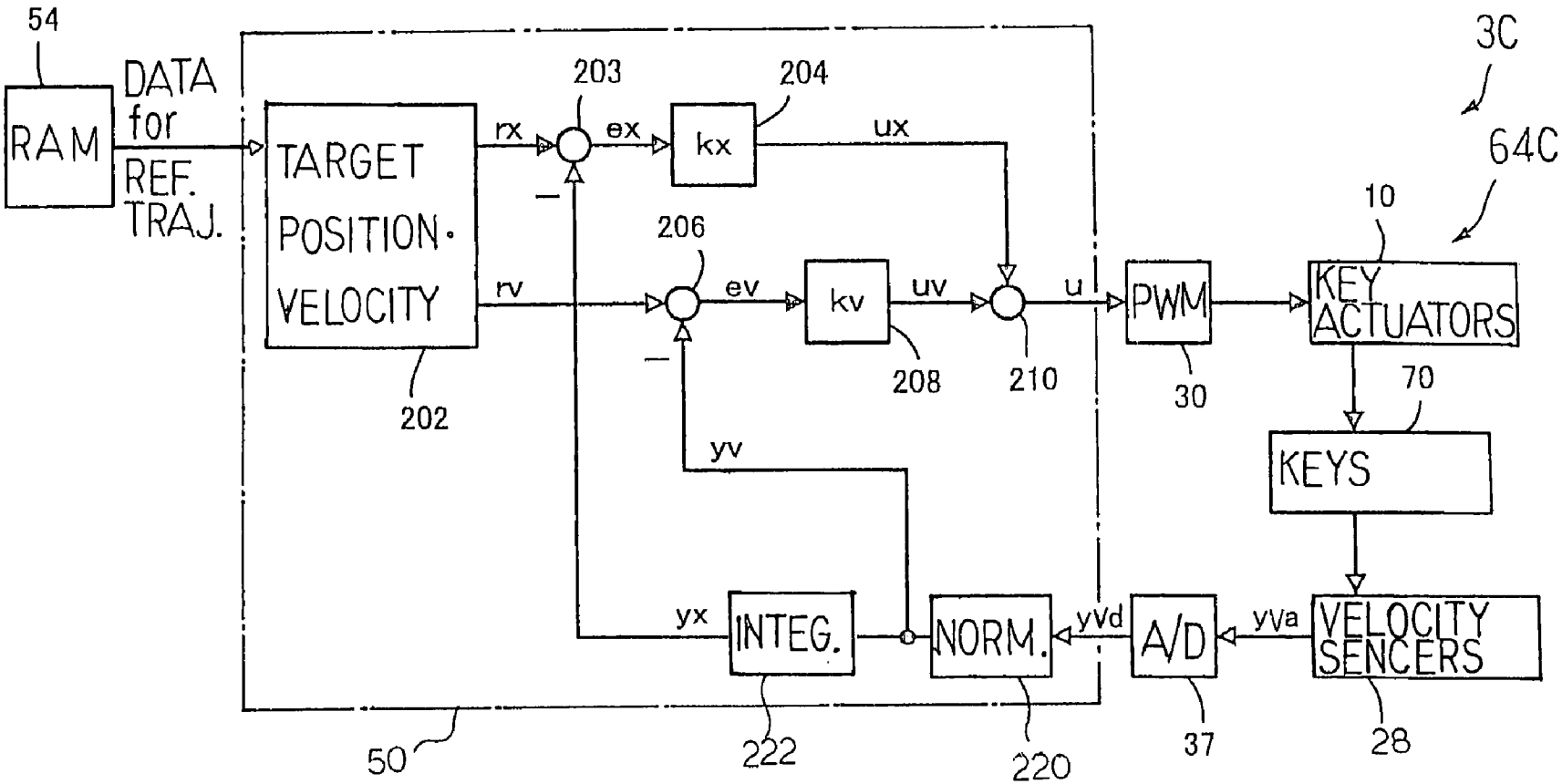
FIG. 6 is a block diagram showing the algorithm employed in a feedback control loop incorporated in still another automatic player piano.

FIG. 6 shows the algorithm employed in a feedback control loop 64C incorporated in still another automatic player keyboard musical instrument embodying the present invention. The automatic player keyboard musical instrument also comprises an acoustic piano, a recording system and an automatic playing system 3C. The acoustic piano and recording system are similar to the acoustic piano and recording system of the automatic player keyboard musical instrument implementing the second embodiment, and the velocity sensors 28 are used in the recording system and automatic playing system 3C. However, the subroutine program for the playback mode and feedback loop 64C are different from those of the automatic playing system 3A. For this reason, description is hereinafter focused on the feedback loop 64C. The system components of the automatic playing system 3C are hereinafter labeled with the references designating the corresponding system components of the automatic playing system 3 without detailed description.

The central processing unit 50, pulse width modulator 30, key actuators 10, keyboard 70, velocity sensors 28 and interface 37 form the feedback loop 64C. The velocity sensors 28 convert the current key velocity "yva" to the analog key velocity signals, and the analog key velocity signals are supplied to the interface 37. The central processing unit 50 realizes the function expressed by boxes 202, 203, 204, 206, 208, 210, 220 and 222 through the execution on the subroutine program. In this instance, the true key position "yx" is calculated on the basis of the true key velocity "yv", and the true key position "yx" and true key velocity "yv" are respectively compared with the target key position and target key velocity for determining a target duty ratio. The functions at circle 203 and box 204 are same as those of the first embodiment, and the functions at circuit 206 and box 208 are same as those of the second embodiment. Thus, the feedback loop 64C is another composite of the feedback loops 64 and 64A. The functions at boxes 202, 203, 204, 206, 208, 210, 220 and 222 are described as follows.

Assuming now that the plunger 15 has already started to project, the velocity sensor 28 determines the current key velocity "yva", and supplies the analog key velocity signal to the interface 37. The analog key velocity signal is converted to a digital key velocity signal representative of the binary code "yvd", the binary number of which is equivalent to the magnitude of the analog key velocity signal. The piece of velocity data, i.e., binary code "yvd" is fetched by the central processing unit 50, and the piece of positional data "yvd" is normalized to a true key velocity "yv" as by box 220. The normalization is the same process as that of the second embodiment. However, when the designer determines the calibration factor, he or she takes the amplifications at boxes 204 and 208 into account.

The central processing unit 50 fetches the piece of normalized velocity data "yv" representative of the true key velocity, and calculates a true key position "yx" through an integration on the true key velocity "yv" as follows.

$$yx = yx1 + yv0 * T[\text{mm}] \qquad \text{Equation 6}$$

where yx1 is the previous true key position, yv0 is the current true key velocity, T is the lapse of time from yx1 and * is the multiplication sign. The lapse of time may be equal to the sampling time interval.

The central processing unit 50 subtracts the true key position "yx" and true key velocity "yv" from the target key position "rx" and target key velocity "ry", which have been already calculated, as by circles 203 and 206. The target key position "rx" and target key velocity "rv" are calculated through Equations 1 and 3, respectively.

The differences "ex" and "ev" are respectively multiplied by the gains "kx" and "kv" as by boxes 204 and 208. The products "ux" and "uv" are indicative of increments or decrements of the mean driving current, that is, increments or decrements of target values of the duty ratio from different aspects. The piece of control data representative of the increments/decrements of the target values of the duty ratio "ux" and "uv" are supplied to the adder 210, and are added to each other. The sum "u" is indicative of an increment or a decrement of a target value of the duty ratio, to which the pulse width modulator 30 is to be adjusted. The sum "u" is supplied to the pulse width modulator 30, and the pulse with modulator 30 adjusts the driving signal to the target duty ratio.

The strength of the magnetic field is varied depending upon the target duty ratio, and the thrust, which is exerted on the plunger 15, is also varied. This results in that the plunger 15 is decelerated, accelerated or maintained in velocity. Although the force, which is exerted on the associated black and white key 72/74, is varied, the key motion does not immediately follow. A time lag occurs between the change of the thrust and the change of the key motion, and is dependent on the individualities of the keyboard 70 and the individualities of the associated key sensor 27. For this reason, even though the velocity sensor 28 exactly converts the current key velocity "yva" to the analog key position signal, the change of the current plunger position is not exactly transferred to the current key velocity "yva". The analog key velocity signal is converted to the digital key velocity signal, and the current key velocity "yva" is expressed by the binary code "yvd".

The central processing unit 50 fetches the piece of positional data or the binary value "yvd" from the interface 37, and normalizes the current key velocity as by box 220. The normalization proceeds as similar to the normalization expressed by Equation 4. The true key velocity "yv" is calculated through the integration (see Equation 5). Thus, the central processing unit 50 prepares the true key position "yx" and true key velocity "yv".

The central processing unit 50 reads out the pieces of control data, and calculates the next target position "rx" and next velocity "rv" as by box 202. The differences "ex" and "ev" are calculated, and the target duty ratio is finally determined as described hereinbefore. Thus, the central processing unit 50 periodically checks the true key velocity "yv" and true key position "yx" to see whether or not the duty ratio, i.e., the thrust exerted on the plunger 15 is proper to force the plunger 15 to move on the reference trajectory through the above-described feedback control loop 64C. For this reason, the pulse width modulator 30 can always adjust the driving signal to the optimum duty ratio.

The central processing unit 50 sequentially processes the event codes, and determines the reference trajectories for the black and white keys 72/74 along the music passage. The associated key actuators 10 are controlled through the feedback control loop 64C, and the black and white keys 72/74 are moved as similar to those in the original performance. Thus, the original performance is reenacted through the automatic playing system 3C.

Although the velocity sensors 28 are shared between the recording system and the automatic playing system 3C, the automatic playing system 3C exactly controls the key motion by virtue of the normalization. Any built-in feedback sensor is not required for the feedback control loop 64C. The standard solenoid-operated key actuators 10 are employable in the automatic playing system 3C. For this reason, the automatic playing system 3C and, accordingly, the automatic player keyboard musical instrument are reduced in production cost without sacrifice of the fidelity of the reproduced performance.

In this instance, the feedback loop 64C controls the duty ratio of the driving signal through both differences "ex" and "ev". For this reason, the pulse width modulator 30 controls the plunger motion more precisely.

Fifth Embodiment

Figure 7:
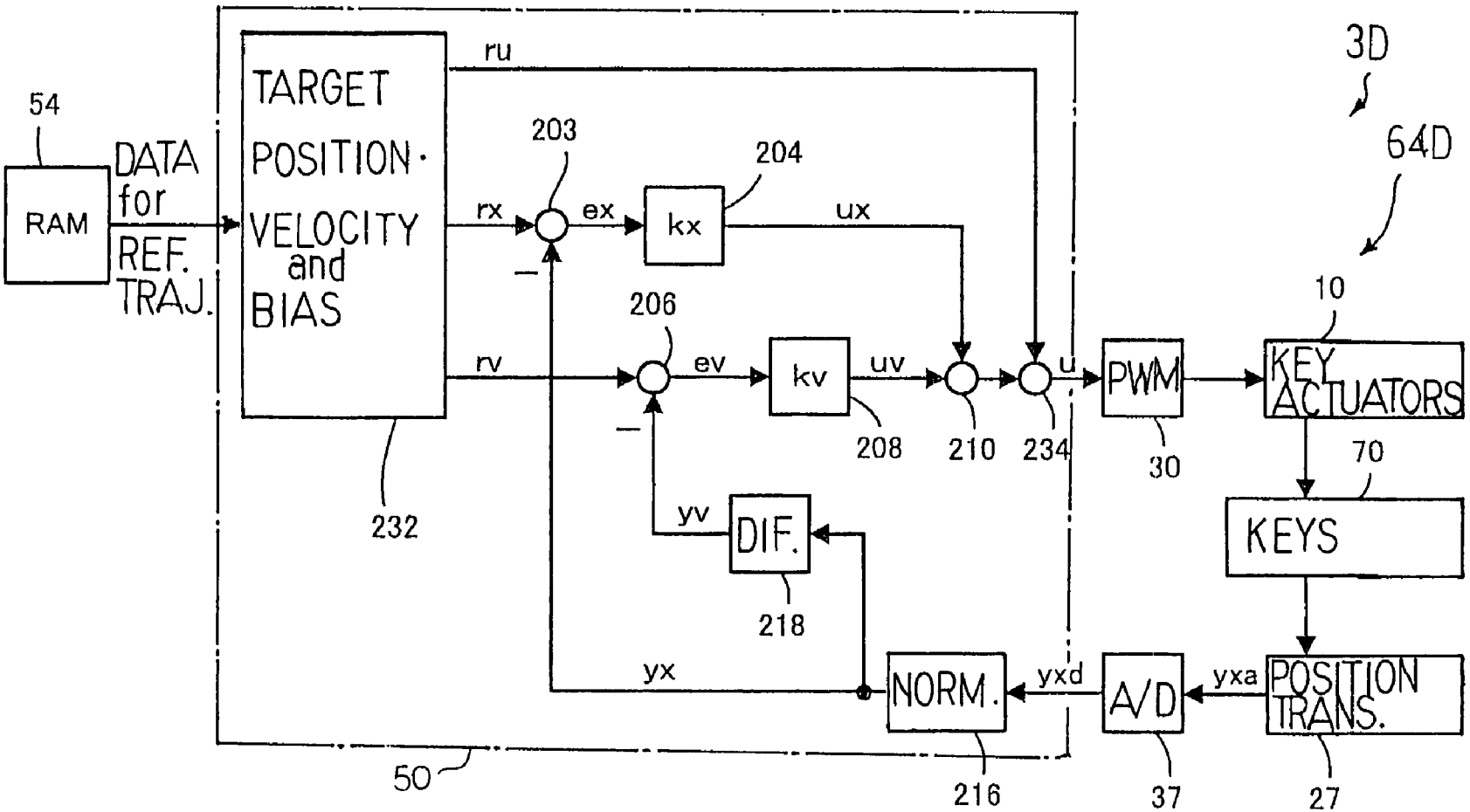
FIG. 7 is a block diagram showing the algorithm employed in a feedback control loop incorporated in yet another automatic player piano.

FIG. 7 shows the algorithm employed in a feedback control loop 64D incorporated in yet another automatic player keyboard musical instrument embodying the present invention. The automatic player keyboard musical instrument also comprises an acoustic piano, a recording system and an automatic playing system 3D. The acoustic piano and recording system are similar to the acoustic piano 1 and recording system 5, and the position transducers 27 are used in the recording system and automatic playing system 3D. However, the subroutine program for the playback mode and feedback loop 64B are different from those of the automatic playing system 3. For this reason, description is hereinafter focused on the feedback loop 64B. The system components of the automatic playing system 3D are hereinafter labeled with the references designating the corresponding system components of the automatic playing system 3 without detailed description.

The central processing unit 50, pulse width modulator 30, key actuators 10, keyboard 70, position transducers 27 and interface 37 form the feedback loop 64D. The position transducers 27 convert the current key position "yxa" to the analog key position signals, and the analog key position signals are supplied to the interface 37. The analog key position signals are converted to digital key position signals through the interface 37.

The central processing unit 50 realizes the function expressed by boxes 232, 203, 204, 206, 208, 210, 216, 218 and 234 through the execution on the subroutine program. Compare FIG. 7 with FIG. 5, we find the differences between the third embodiment and the fifth embodiment to be directed to box 232 and circle 234. Not only target position "rx" and target velocity "rv" but also bias "ru" are output from box 232. The target position "rx" and target velocity "rv" are same as those shown in FIG. 5. The bias "ru" is indicative of a bias voltage to be supplied to the key actuators 10. The reason why the bias voltage is required for the key actuators 10 is prompt response to the driving current. The driving signal is assumed to rise from zero. The plunger 15 does not immediately project from the combined structure of solenoid and yoke 17, because various sorts of resistance such as the weight of the key 72/74 and the elastic force of a return spring are exerted against the plunger 15. When the magnetic force exceeds the total resistance, the plunger 15 starts to project. The bias voltage causes the combined structure of solenoid and yoke 17 to exert the critical magnetic force, which is equivalent to the total resistance, on the plunger 15. The pulse width modulator 30 always applies the bias voltage to the combined structures of solenoids and yoke 17. When the pulse width modulator 30 raises the driving signal, the plunger 15 immediately projects from the combined structure of solenoid and yoke 17. Thus, the key actuators 10 are improved in promptness by virtue of the bias "ru".

In this instance, although the bias "ru" is varied, a constant bias "ru" is output from box 232, and the adder 234 adds the bias "ru" to the sum of the "ux" and "uv". However, the functions at the other boxes and circles are same as those shown in FIG. 5. For this reason, the behavior of the feedback loop 64E is not described for avoiding repetition.

Sixth Embodiment

Figure 8:
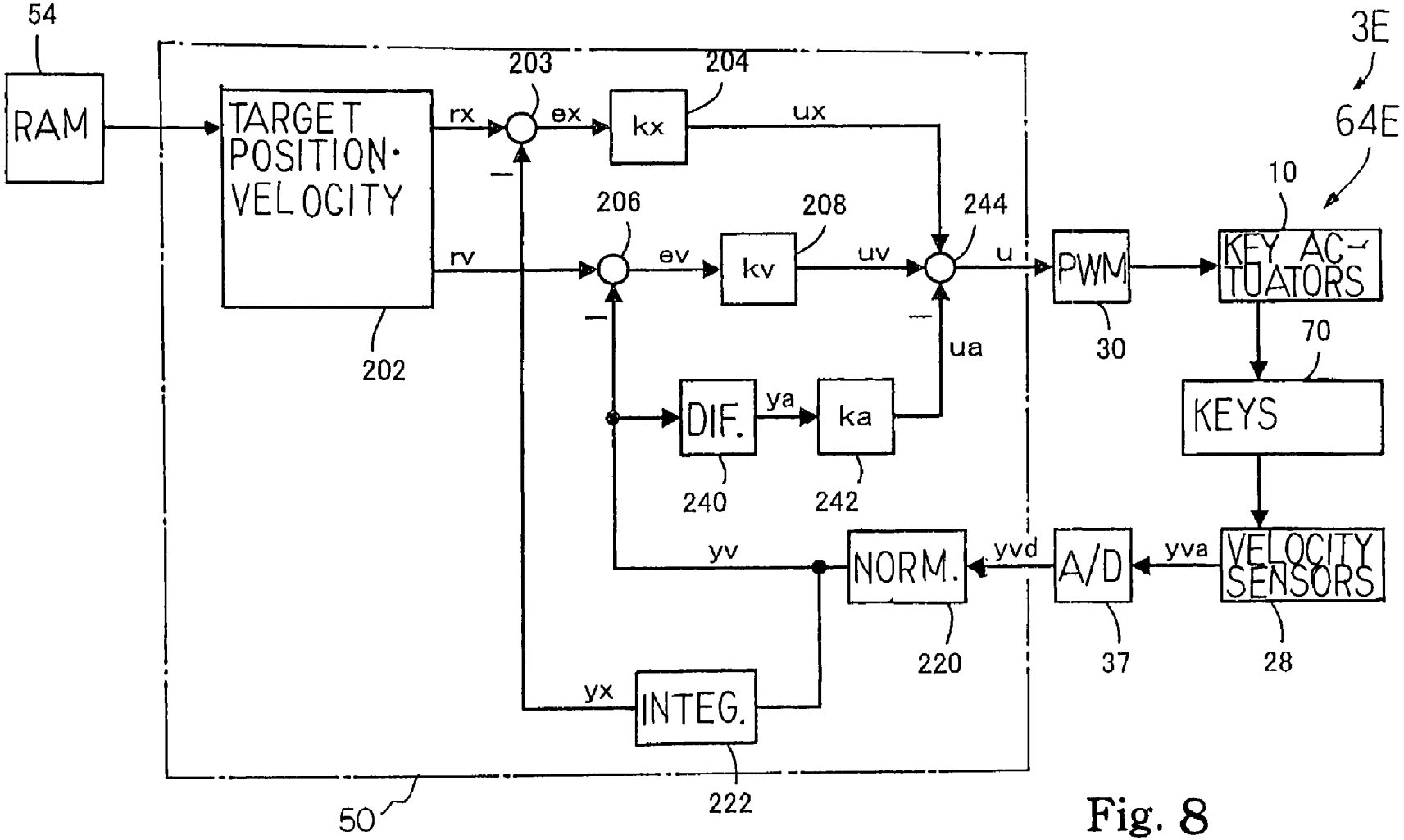
FIG. 8 is a block diagram showing the algorithm employed in a feedback control loop incorporated in still another automatic player piano.

FIG. 8 shows the algorithm employed in a feedback control loop 64E incorporated in still another automatic player keyboard musical instrument embodying the present invention. The automatic player keyboard musical instrument also comprises an acoustic piano, a recording system and an automatic playing system 3E. The acoustic piano and recording system are similar to the acoustic piano and recording system of the second embodiment, and the velocity sensors 28 are used in the recording system and automatic playing system 3E. However, the subroutine program for the playback mode and feedback loop 64E are different from those of the automatic playing system of the second embodiment. For this reason, description is hereinafter focused on the feedback loop 64E. The system components of the automatic playing system 3E are hereinafter labeled with the references designating the corresponding system components of the automatic playing system 3 without detailed description.

The central processing unit 50, pulse width modulator 30, key actuators 10, keyboard 70, velocity sensors 28 and interface 37 form the feedback loop 64E. The velocity sensors 28 convert the current key velocity "yva" to the analog key velocity signals, and the analog key velocity signals are supplied to the interface 37. The analog key velocity signals are converted to digital key velocity signals through the interface 37.

The central processing unit 50 realizes the function expressed by boxes 202, 203, 204, 206, 208, 220, 222, 240, 242 and 244 through the execution on the subroutine program. Comparing FIG. 8 with FIG. 6, we find differences between the fourth embodiment and the sixth embodiment to be directed to boxes 240 and 242 and circle 244. A true acceleration "ya" is calculated on the basis of the true key velocity through a differentiation as by box 240, and is amplified with gain "ka" as by box 242. The product "ua" is indicative of the acceleration, and is supplied to the adder 244. The adder 244 adds the increment/decrement "ux" to the increment/decrement "uv", and subtracts the acceleration "ua" from the sum, i.e., u=ux+uv−ua. Thus, the increment/decrement "ux"+"uv" is modified with the acceleration "ua". The modified increment/decrement "u" is supplied to the pulse width modulator 30, and the pulse width modulator 30 adjusts the driving signal to the target duty ratio. When the designer determines the calibration factor for the gain, he or she takes the amplifications at boxes 204, 208 and 242 into account. The other functions are same as those of the fourth embodiment, and no further description is omitted for the sake of simplicity.

The modification with the acceleration "ua" is preferable to the adjustment of the driving signal to the duty ratio in the fourth embodiment. For example, when the acceleration is large, the increment/decrement "ux+uv" is reduced. This results in that the plunger 15 and, accordingly, key 72/74 is prevented from an overshoot on the reference trajectory.

As will be appreciated from the foregoing description, the remote sensors 27/28 are shared between the recording system 3 and the automatic playing system 3/3A/3B/3C/3D/3E, and, for this reason, the standard key actuators 10 are used in the automatic playing system 3/3A/3B/3C/3D/3E. Any key actuator with built-in feedback sensor is not required for the automatic playing system 3/3A/3B/3C/3D/3E. This results in reduction of the production cost without sacrifice of the fidelity of the performance reenacted in the playback mode.

Although particular embodiments of the present invention have been shown and described, it will be apparent to those skilled in the art that various changes and modifications may be made without departing from the spirit and scope of the present invention.

The grand piano does not set any limit to the technical scope of the present invention. An automatic player piano may be built on the basis of an upright piano. The grand piano may be replaced with another sort of keyboard musical instrument such as, for example, a mute piano, a harpsichord or an organ. A mute piano is a combination of the acoustic piano, a hammer stopper and an electronic tone generating system. The hammer stopper is changed between a free position and a blocking position. While the hammer stopper is staying in the free position, the strings are struck with the hammers at the end of the free rotation, and the acoustic piano tones are generated through the vibrations of the strings. When the hammer stopper is changed to the blocking position, the hammer stopper enters the trajectories of the hammers. Although the hammers are driven for the free rotation, the hammers rebound on the hammer stopper before the end of the free rotation, and any acoustic piano tone is not produced. The electronic tone generating system monitors the keys selectively depressed and released by the player, and electronically produces tones at pitches equal to the pitches assigned to the depressed keys.

The position transducer 27 and velocity sensor 28 do not set any limit to the technical scope of the present invention. The position transducers 27 or velocity sensors 28 may be replaced with another sort of sensors such as, for example, acceleration sensors or pressure sensors in so far as the detected physical quantity expresses the key motion.

The objects, the motion of which is converted to the physical quantity, is never limited to the black and white keys 72/74. The hammer position transducers 22 or hammer velocity sensors may be incorporated in the feedback loop 64/64A/64B/64C/64D/64E. Any component part such as, for example, capstan screws, which are provided between the black and white keys 72/74 and the action units 90, or component parts of the action units 90 may be monitored by the sensors. In this instance, the calibration factor for the offset is determined in such a manner that the deformation from the keys 72/74 to the monitored parts as well as the installation error are canceled.

The combinations of target position and target velocity do not set any limit on the technical scope of the present invention. The central processing unit may determine a target acceleration on the reference trajectories. A box, which corresponds to box 202, by way of example, may output the target acceleration together with the target position, target velocity and/or target force.

The flexible disc driver 40 does not set any limit on the technical scope of the present invention. Other sorts of memories such as, for example, a CDWR (Compact Disc ReWriteable) driver, a hard disc driver, a driver for a memory stick and drivers for semiconductor memories are available for the automatic player keyboard musical instrument according to the present invention. Moreover, the controller 100 may communicate with a server computer through a public or private communication network. In this instance, the music data codes are stored in the server computer, and are distributed to the automatic player keyboard musical instruments and other electronic musical instruments on demand.

The solenoid-operated key actuator units 10 do not set any limit to the technical scope of the present invention. Pneumatic actuator units or a motor-driven actuator system may be incorporated in the automatic player keyboard musical instrument according to the present invention.

The hammer sensors 22 may be eliminated from the recording system. In this instance, the timing at which the strings 96 are struck with the hammers 94 is estimated on the basis of the series of current key positions. Thus, the hammer sensors 22 are not the indispensable elements of the recording system 5.

The light emitting diode and phototransistor do not set any limit to the technical scope of the present invention. A piece of permanent magnet and a magnetic sensor may be used as the key sensor and/or hammer sensor.

The flash electrically erasable and programmable read only memory 52 does not set any limit on the technical scope of the present invention. A read only memory or a bubble memory is available for the controller 100, and the computer program and pieces of control data may be stored in a hard disc. Otherwise, the computer program and pieces of control data may be supplied through a public/private communication network. In this instance, the flash electrically erasable and programmable read only memory 52 is deleted from the controller 100.

Claim languages are correlated with the component parts of the above-described embodiments as follows. The black and white keys 72/74, action units 90 and hammers 94 as a whole constitute plural motion propagating paths. The strings 96 form in combination a tone generating sub-system. The black and white keys 72/74 serve as predetermined component parts.

The key actuators 10 serve as plural actuators. The position transducers 27 and velocity sensors 28 are corresponding to plural sensors. The feedback control loops 64/64A/64B/64C/64D/64E serve as plural feedback control loops. The central processing unit 50 carries out the normalization at box 216 or 220, and optimizes the driving signal at boxes 201/203/204, 205/206/208, 202/203/204/206/208/210/218, 202/203/204/206/208/210/222, 232/203/204/206/208/210/218/234 or 202/203/204/206/208/222/240/242/244 in cooperation with the pulse width modulator 30.

What is claimed is:

1. An automatic player keyboard musical instrument for producing tones, comprising:

a keyboard musical instrument including a tone generating sub-system for producing said tones, and plural motion propagating paths each having plural component parts connected in series toward said tone generating sub-system and sequentially moved for specifying a pitch of the tone to be produced;

an automatic playing system showing an individuality together with said plural motion propagating paths and including plural actuators respectively associated with said plural motion propagating paths and selectively energized with driving signals so as selectively to cause the associated motion propagating paths to move, plural sensors remote from said plural actuators and respectively converting a motion of predetermined component parts of said plural motion propagating paths to detecting signals representative of a current physical quantity expressing said motion, and plural feedback control loops connected between said plural sensors and said plural actuators, normalizing said current physical quantity so as to eliminate said individuality from said current physical quantity for determining a true physical quantity and optimizing said driving signals on the basis of said true physical quantity for controlling the motion of said predetermined component parts; and a recording system sharing said plural sensors with said automatic playing system, and analyzing said current physical quantity for producing pieces of music data representative of a performance on said keyboard musical instrument.

2. The automatic player keyboard musical instrument as set forth in claim 1, in which said plural feedback loops respectively compare plural series of values of said true physical quantity with plural series of values of a target physical quantity expressing reference trajectories of said predetermined component parts determined on the basis of the pieces of music data to see whether or not said predetermined component parts are moved on said reference trajectories, and vary a magnitude of said driving signals for the optimization when said predetermined component parts are deviated from said reference trajectories.

3. The automatic player keyboard musical instrument as set forth in claim 2, in which said true physical quantity and said target physical quantity are representative of at least one of the position, velocity and acceleration.

4. The automatic player keyboard musical instrument as set forth in claim 2, in which said true physical quantity and said target physical quantity are representative of more than one of the position, velocity and acceleration.

5. The automatic player keyboard musical instrument as set forth in claim 2, in which said true physical quantity and said target physical quantity are representative of both of the position and the velocity, and said plural feedback control loops calculate a true acceleration of said predetermined component parts, and bias said driving signals with values of said true acceleration.

6. The automatic player keyboard musical instrument as set forth in claim 1, in which each of said plural feedback control loops biases associated one of said driving signals with a value which is equivalent to a resistance against a motion of associated one of said plural actuators.

7. The automatic player keyboard musical instrument as set forth in claim 1, in which each of said plural motion propagating paths includes a key rotatably supported at an intermediate portion thereof and depressed by a human player at a front portion thereof so that said human player gives rise to angular motion of said key, an action unit provided over said key and connected to a rear portion of said key so that the depressed key gives rise to another sort of motion of said action unit, and a hammer connected to said action unit so that said action unit gives rise to rotation of said hammer.

8. The automatic player keyboard musical instrument as set forth in claim 7, in which said key serves as the predetermined component part so that associated one of said plural sensors converts said current physical quantity expressing said angular motion to the detecting signal.

9. The automatic player keyboard musical instrument as set forth in claim 7, in which said plural actuators give rise to said angular motion of the keys respectively incorporated in said plural motion propagating paths, respectively.

10. The automatic player keyboard musical instrument as set forth in claim 9, in which said keys have manufacturing errors causative of said individuality.

11. The automatic player keyboard musical instrument as set forth in claim 9, in which each of said detecting signals is representative of a current key position of the associated key so that said angular motion is expressed by a series of values of said current key positions.

12. The automatic player keyboard musical instrument as set forth in claim 11, in which said plural feedback control loops determine reference trajectories respectively expressed by plural series of values of a target key position, compare plural series of values of a true key position determined on the basis of the plural series of values of said current key position through the normalization with said plural series of values of said target key position to see whether or not said keys are respectively moved on said reference trajectories, and vary a magnitude of said driving signals when said keys are deviated from said reference trajectories.

13. The automatic player keyboard musical instrument as set forth in claim 12, in which said plural feedback control loops further determine plural series of values of a target key velocity on said reference trajectories and plural series of values of a true key velocity at said plural series of values of said true key position, respectively compare said plural series of values of said true key position and said plural series of values of said true key velocity with said plural series of values of said target key position and said plural series of values of said target key velocity to see whether or not said keys are respectively moved on said reference trajectories, and vary the magnitude of said driving signals when said keys are deviated from said reference trajectories.

14. The automatic player keyboard musical instrument as set forth in claim 9, in which each of said detecting signals is representative of a current key velocity of the associated key so that said angular motion is expressed by a series of values of said current key velocity.

15. The automatic player keyboard musical instrument as set forth in claim 14, in which said plural feedback control loops determine reference trajectories respectively expressed by plural series of values of a target key velocity, compare plural series of values of a true key velocity determined on the basis of the plural series of values of said current key velocity through the normalization with said plural series of values of said target key velocity to see whether or not said keys are respectively moved on said reference trajectories, and vary a magnitude of said driving signals when said keys are deviated from said reference trajectories.

16. The automatic player keyboard musical instrument as set forth in claim 15, in which said plural feedback control loops further determine plural series of values of a target key position on said reference trajectories and plural series of values of a true key position at which said plural series of values of said true key velocity are determined, respectively compare said plural series of values of said true key position and said plural series of values of said true key velocity with said plural series of values of said target key position and said plural series of values of said target key velocity to see whether or not said keys are respectively moved on said reference trajectories, and vary the magnitude of said driving signals when said keys are deviated from said reference trajectories.

17. The automatic player keyboard musical instrument as set forth in claim 1, in which said plural sensors are of a non-contact type.

18. The automatic player keyboard musical instrument as set forth in claim 17, in which said plural sensors have errors causative of said individuality.

* * * * *

UNITED STATES PATENT AND TRADEMARK OFFICE

CERTIFICATE OF CORRECTION

PATENT NO. : 6,969,791 B2
DATED : November 29, 2005
INVENTOR(S) : Yuji Fujiwara

It is certified that error appears in the above-identified patent and that said Letters Patent is hereby corrected as shown below:

Title page,
Insert Item -- [30] Foreign Application Priority Data
Mar. 27, 2003 (JP) ..... 2003-087209 --.

Signed and Sealed this

Twenty-eighth Day of March, 2006

JON W. DUDAS
*Director of the United States Patent and Trademark Office*